US005774145A

United States Patent [19]

Morita et al.

[11] Patent Number: 5,774,145

[45] Date of Patent: Jun. 30, 1998

[54] INK JET PRINT HEAD AND IMAGE RECORDING APPARATUS

[75] Inventors: Naoki Morita; Naoshi Kotake; Yutaka Mori, all of Ebina, Japan

[73] Assignee: Fuji Xerox Co., Ltd., Tokyo, Japan

[21] Appl. No.: 635,628

[22] Filed: Apr. 22, 1996

[30] Foreign Application Priority Data

Apr. 27, 1995 [JP] Japan ..... 7-103662

[51] Int. Cl.[6] ..... B41J 2/145; B41J 2/14

[52] U.S. Cl. ..... 347/43; 347/47; 347/40

[58] Field of Search ..... 347/43, 40, 47

[56] References Cited

U.S. PATENT DOCUMENTS

| | | | |
|---|---|---|---|
| 4,320,046 | 3/1982 | Havens . | |
| 4,337,468 | 6/1982 | Mizuno | 347/7 |
| 4,882,595 | 11/1989 | Trueba et al. | 34/85 |
| 5,262,802 | 11/1993 | Karita et al. | 347/87 |
| 5,355,158 | 10/1994 | Inada et al. . | |
| 5,493,319 | 2/1996 | Hirabayashi et al. | 347/29 |
| 5,627,572 | 5/1997 | Harrington, III et al. | 347/23 |
| 5,670,996 | 9/1997 | Mitani | 347/29 |

FOREIGN PATENT DOCUMENTS

| | | |
|---|---|---|
| 0612624-A1 | 8/1994 | European Pat. Off. . |
| 0656261-A2 | 6/1995 | European Pat. Off. . |
| 1-12675 | 3/1989 | Japan . |
| 2-204053 | 8/1990 | Japan . |
| 4-263949 | 9/1992 | Japan . |
| 5-138884 | 6/1993 | Japan . |
| 6-183002 | 7/1994 | Japan . |
| 7-17062 | 1/1995 | Japan . |
| 7-25031 | 1/1995 | Japan . |

*Primary Examiner*—Peter S. Wong
*Assistant Examiner*—Gregory J. Toatley, Jr.
*Attorney, Agent, or Firm*—Oliff & Berridge, PLC

[57] ABSTRACT

Ink reservoirs are provided in a channel substrate correspondingly to various colors of ink. Two or more dummy nozzles which are not used for performing printing/recording are provided between printing/recording nozzles for jetting ink of different colors. A space wide enough to disposed therein at least two nozzles is provided between the dummy nozzles. Consequently, adjacent and different-color ink is not mixed, and nozzles having unstable operation and disposed near the side walls of the ink reservoirs are not used for performing printing/recording, so that images of high quality can be obtained.

9 Claims, 9 Drawing Sheets

INK JET PRINT HEAD AND IMAGE RECORDING APPARATUS

BACKGROUND OF THE INVENTION

The present invention relates to an ink jet print head and an image recording apparatus for jetting ink from nozzles to perform printing/recording, and particularly relates to an ink jet print head and an image recording apparatus for performing printing/recording with ink of a plurality of different colors.

As an ink jet type recording apparatus for performing printing/recording with ink of a plurality of different colors, that which is provided a group of nozzles for jetting multi-color ink disposed in one head has been known as disclosed in Japanese Patent Post-Examination No. Hei. 1-12675. Further, that which is provided with four color printing heads in combination has been also known, for example, as disclosed in Japanese Patent Unexamined publication No. Hei. 2-204053.

In a structure in which such nozzles for jetting multi-color ink are stored in one head or in which printing heads are combined, there has been a problem that color mixture arises between different colors disposed adjacently. In order to solve this problem, the interval between nozzle groups for jetting ink of different colors is made larger than the interval between nozzles, for example, in Japanese Patent Unexamined Publication No. Hei. 4-263949. Consequently, there is no fear that different ink colors are disposed adjacently to each other on a print medium, so that color mixture can be avoided. However, this document fails to disclose a structure having dummy nozzles which as will be described later.

In addition, in such an ink jet head where nozzles for jetting multi-color ink are disposed adjacently to each other, there is a case where ink adhering to a nozzle surface is mixed with ink of another color by wiping or priming at the time of maintenance, resulting in color mixture. As a technique to solve such a problem, it is possible to consider, for example, a structure where dicing grooves are provided between nozzle groups of different colors so that the dicing grooves can absorb mixed ink as disclosed in Japanese Patent Unexamined Publication No. Hei. 7-17062, or dummy nozzles for absorbing mixed ink are provided between nozzle groups of different colors as disclosed in Japanese Patent Unexamined Publication No. Hei. 7-25031.

On the other hand, a structure where two silicon wafer are used has been known as the structure of an ink jet head. FIGS. 12A to 12C are explanatory diagrams of an example of a conventional ink jet head. Specifically, FIG. 12A is a perspective view of a channel substrate, FIG. 12B is a plan view of the channel substrate, and FIG. 12C is a sectional view of the state where two substrates are bonded. In the drawings, the reference numeral 51 represents a channel substrate; 52, an etching mask; 53, an ink channel; 54, an ink reservoir; 55, a nozzle; 56, a heater substrate; and 57, a heating element.

In the channel substrate 51, individual ink channels 53 and the common ink reservoir 54 are formed by anisotropic etching with the etching mask 52. The ink channels 53 and the ink reservoir 54 are combined by dicing or the like. In addition, the heating element 57 is provided for each of the ink channels 53 on the heater substrate 56. The channel substrate 51 and the heater substrate 56 are bonded with each other, and cut to open the ink channel 53 to form the nozzle 55, thereby forming an ink jet head shown in FIG. 12C.

In the ink jet head shown in FIGS. 12A to 12C, the ink reservoir 54 is formed by anisotropic etching so as to make the ink reservoir 54 wider from the ink supply hole toward the ink channel 53, so that the side surface of the ink reservoir 54 contacts with the surface of the heater substrate 56 at an acute angle. Therefore, ink is apt to stay in the circumferential portion of the ink reservoir 54, so that the ink is not supplied to the ink channel 53 satisfactorily. Accordingly, there has been such a problem that ink is prevented from jetting from the nozzle 55.

In order to solve this problem, for example, in an ink jet recording head disclosed in Japanese Patent Unexamined Publication No. Hei. 5-138884, Japanese Patent Unexamined Publication No. Hei. 6-183002, or the like, nozzles disposed in the circumferential portion of an ink reservoir are set as dummy nozzles which are not used for printing so as to stabilize jetting of the other nozzles to thereby obtain good recording quality. This technique is however for a single color ink jet recording head, and it is not suitable for a multi-color ink jet recording head. Although the above Japanese Patent Unexamined Publication No. Hei. 7-25031 discloses provision of dummy nozzles, these dummy nozzles do not communicate with an ink reservoir, so that it is impossible to avoid failure in ink jetting in the circumferential portion of the ink reservoir.

SUMMARY OF THE INVENTION

Taking the foregoing problems into consideration, it is an object of the present invention to provide an ink jet print head and an image recording apparatus in which not only color mixture but also failure of ink jetting can be prevented to is perform stable printing.

In order to achieve the above object, according to a first aspect of the present invention, provided is an ink jet print head having nozzles for jetting ink of a plurality of different colors, wherein two or more dummy nozzles which are not used for printing/recording are provided between the nozzles for jetting ink of different colors for performing printing/recording, a space wide enough to dispose therein two or more nozzles is provided between at least two of the dummy nozzles.

Preferably, according to second aspect of the present invention, the dummy nozzles are designed so as to be able to jet ink in response to a printing signal.

preferably, according to a third aspect of the present invention, the dummy nozzles have substantially the same jetting hole as the nozzles for printing/recording.

Preferably, according to a fourth aspect of the present invention, the dummy nozzles are disposed at the same intervals as the nozzles for performing printing/recording.

According to a fifth aspect of the present invention, provided is an ink jet print head having nozzles for jetting ink of a plurality of different colors, wherein at least four dummy nozzles which are not used for printing/recording are provided between the nozzles for jetting ink of different colors, and any of the dummy nozzles which is directly adjacently to the nozzles is an inside dummy nozzle opened so as to be able to perform printing while any of the dummy nozzles which is directly adjacently to the inside dummy nozzle is an outside dummy nozzle with its opening portion closed.

Preferably, according to a sixth aspect of the present invention, the outside dummy nozzle is provided with no wiring for supplying a printing signal thereto.

Further, according to an seventh aspect of the present invention, provided is an image recording apparatus having nozzles for jetting ink of a plurality of different colors, wherein the apparatus has a first nozzle group for jetting ink, a second nozzle group adjacent to the first nozzle group and for jetting ink different in color from the ink jetted from the first nozzle group, a first dummy nozzle disposed between the first nozzle group and the second nozzle group and having no opening portion, and second dummy nozzles disposed between the first dummy nozzle and the first nozzle group and between the first dummy nozzle and the second nozzle group, respectively, each of the second dummy nozzles being opened so as to be able to perform printing.

Preferably, according to a eighth aspect of the present invention, the dummy nozzles have substantially the same jetting hole as the nozzles for printing/recording.

Preferably, according to a ninth aspect of the present invention, the dummy nozzles are disposed at the same intervals as the nozzles for performing printing/recording.

According to the invention of the first aspect, two or more dummy nozzles which are not used for printing/recording are provided between nozzles for jetting ink of different colors for performing printing/recording, and a space which is wide enough to dispose therein two or more nozzles is provided between at least two of the dummy nozzles. Therefore, a space which is wide enough to dispose therein four or more nozzles is provided between the nozzles for jetting ink of different colors for performing printing/recording to thereby make it possible to prevent color mixture.

In addition, when the dummy nozzles are designed to be connected to an ink reservoir so as to jet ink in response to a printing signal according to the second aspect of the present invention, it is possible to perform printing/recording only with stable nozzles, that is, without using any nozzle near the side surface of the ink reservoir. In addition, in the operation of priming performed at the time of maintenance, not only is it possible to jet ink to discharge bubbles into the ink reservoir, or the like, but also it is possible to blow mixed ink adhering on the surroundings.

The dummy nozzles may be designed to have almost the same jetting hole as the nozzles for performing printing/recording according to the third aspect of the present invention, and the distance between the dummy nozzles can be designed to be substantially the same as that of the nozzles for performing printing/recording according to the fourth aspect of the present invention. Since the dummy nozzles can be formed in the same manner as the nozzles for performing printing/recording in such a structure, it is possible to form the dummy nozzles without any special manufacturing process.

According to the fifth aspect of the present invention, at least four dummy nozzles which are not used for printing/recording are provided between the nozzles for jetting ink of different colors for performing printing/recording, so that it is possible to prevent color mixture. Then, any of the dummy nozzles directly adjacently to the nozzles for performing printing/recording may be made to be an inside dummy nozzle opened so as to be able to perform printing while any of the dummy nozzles directly adjacently to the inside dummy nozzle may be made to be an outside dummy nozzle with its opening portion closed. Since this outside dummy nozzle cannot jet ink, the outside dummy nozzle may be designed without wiring for supplying a printing signal as stated in the sixth aspect of the present invention.

When an image recording apparatus is designed with such an ink jet print head according to the seventh aspect of the present invention, it is possible to provide an image recording apparatus in which no color mixture occurs and operation is stable. In addition, according to the eighth aspect of the present invention, a first dummy nozzle having no opening portion is disposed between first and second nozzle groups for jetting ink of different colors, and second dummy nozzles each having an opening portion for performing printing are disposed between the first dummy nozzle and the first nozzle group and between the first dummy nozzle and the second nozzle group, respectively, in the same manner as stated in the fifth and sixth aspects of the present invention. Accordingly, it is possible to provide an image recording apparatus in which no color mixture occurs and operation is stable so that it is possible to obtain a good printed image.

DETAILED DESCRIPTION OF THE PREFERRED EMBODIMENTS

Figure 1A:
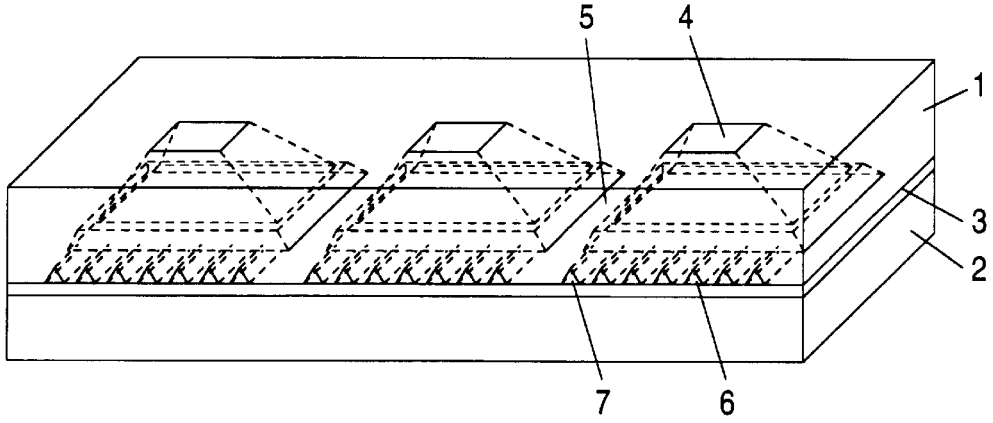
FIGS. 1A and 1B are schematic diagrams illustrating an embodiment of an ink jet print head according to the present invention.
Figure 1B:
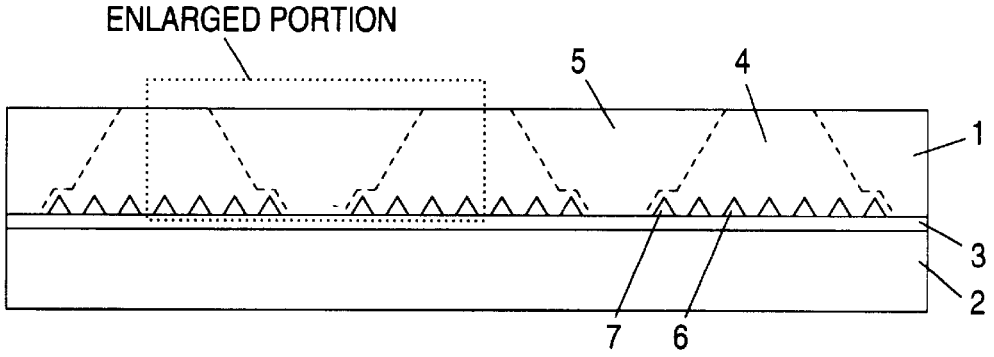
Figure 2:
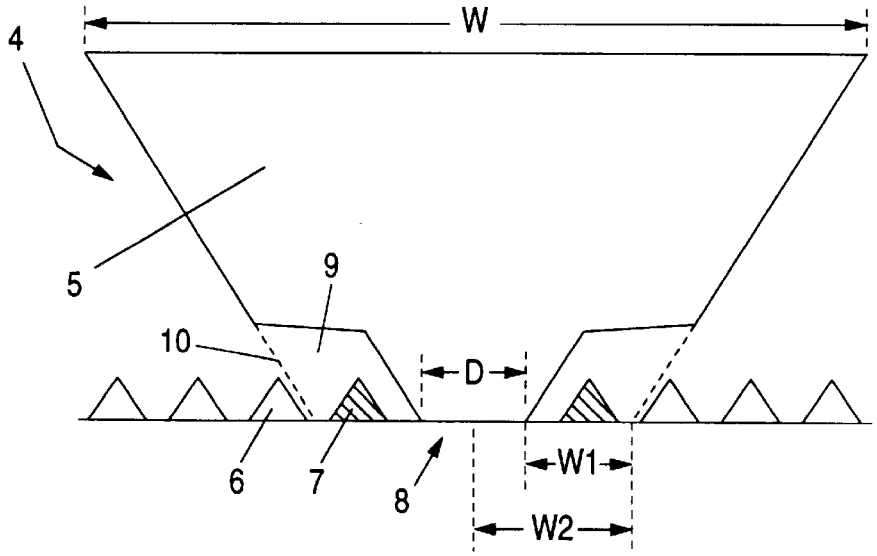
FIG. 2 is an enlarged diagram of a portion where nozzles for different colors are adjacent to each other in an embodiment of an ink jet print head according to the present invention.

FIGS. 1A and 1B are schematic diagrams illustrating an embodiment of an ink jet print head according to the present invention. Specifically, FIG. 1A is a perspective view, and FIG. 1B is a front view. FIG. 2 is an enlarged view of a portion where nozzles of different colors are disposed adjacently to each other in the same ink jet print head. In the drawings, the reference numeral 1 represents a channel substrate; 2, a heater substrate; 3, a thick film resin layer; 4, an ink reservoir; 5, a reservoir partition; 6, a printing/recording nozzle; 7, a dummy nozzle; 8, a space; 9, a shallow grooved area; and 10, an extended line of an inner wall. A plurality of ink channels and ink reservoirs 4 are formed in the channel substrate 1. The ink reservoirs 4 are formed correspondingly to respective ink colors. Since a three-color integrated type ink jet print head is illustrated herein, three ink reservoirs 4 are provided. In this case, three colors such as yellow (Y), magenta (M) and cyan C can be used as the ink. The respective ink reservoirs 4 are separated by the reservoir partition 5. The ink reservoirs 4 are formed penetrating the channel substrate 1, and ink of the respective colors is supplied through these through holes. In addition, as will be described later, the ink reservoirs 4 are formed by twice anisotropic etching so as to make the through holes small and make width W of their sealing area large in order to ensure bonding and sealing between ink supply members and the through holes. Further, shallow grooved areas 9 are formed near the side walls of the ink reservoirs 4 which are near the ink channels.

A Plurality of ink channels are formed in three groups corresponding to the respective colors so as to communicate with their corresponding ink reservoirs 4. A heating element is provided in each of the ink channels so as to be driven by a driving control portion to generate heat to thereby make bubbles grow in the ink so that the ink is jetted from the nozzle by the pressure of the bubbles. Of the plurality of ink channels connected to the respective ink reservoirs 4, ink channels on the both sides are used as dummy nozzles 7, and the others are used as printing/recording nozzles 6. That is, only the printing/recording nozzles 6 are used at the time of printing/recording.

Figure 12A:
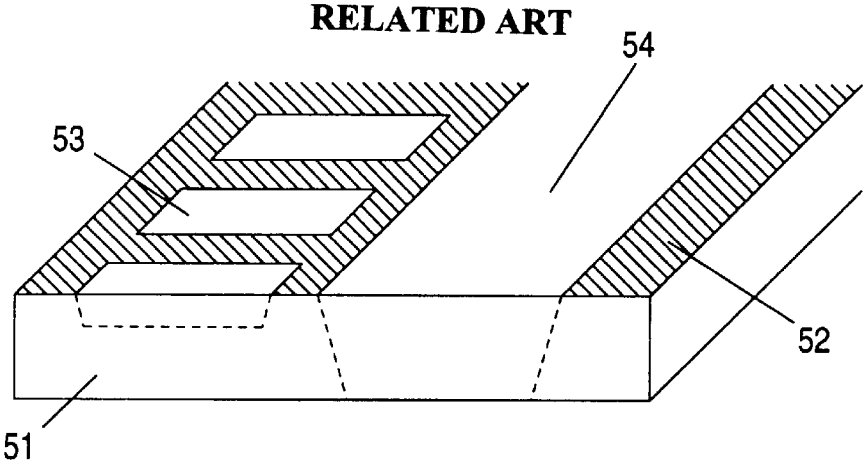
FIG. 12A RELATED ART
FIGS. 12A to 12C are explanatory diagram of an example of a conventional ink jet head.
Figure 12B:
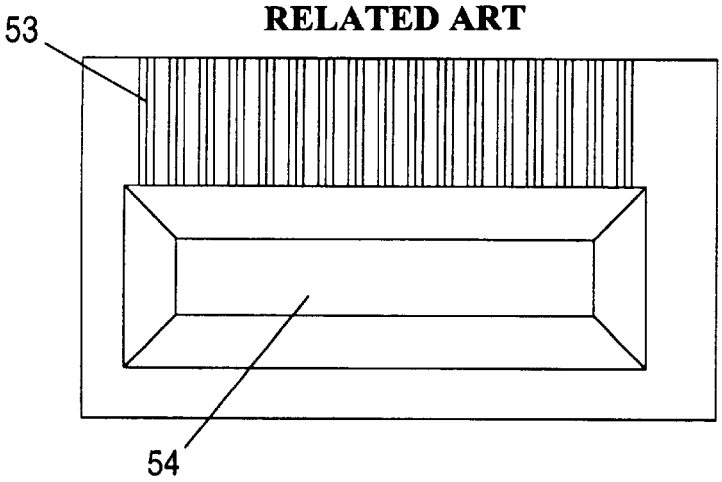
FIG. 12B RELATED ART
Figure 12C:
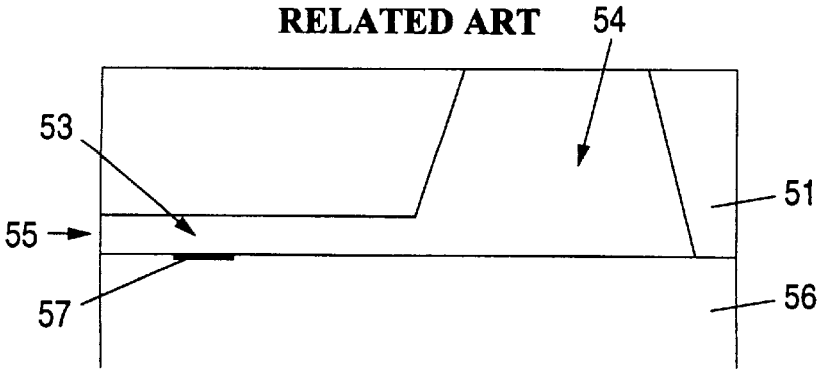
FIG. 12C RELATED ART

As was described in FIGS. 12A to 12C, jetting of ink is apt to be unstable in any nozzle near the side surfaces of the ink reservoirs 4. Particularly, a failure of jetting is apt to arise outside the extended line 10 of the inside wall because the shallow grooved areas 9 are provided as shown in FIG. 2. Therefore, the dummy nozzles 7 are not used for printing/recording. However, the dummy nozzles 7 can jet ink. For example, ink can be jetted at the time of maintenance, or absorbed from the dummy nozzles 7 by the priming operation. Accordingly, bubbles, dust, or the like, staying near the side surfaces of the ink reservoirs 4 or in the shallow grooved areas 9 can be discharged to the outside with ink from the dummy nozzles 7, so that it is possible to reduce failures of jetting at the time of printing/recording.

A space 8 wide enough to dispose therein two nozzles at the same pitch as that of the printing/recording nozzles 6 and the dummy nozzles 7 is provided between adjacent dummy nozzles 7. This space 8 and the interval between the dummy nozzles 7, that is, the interval corresponding to four nozzles are formed between the printing/recording nozzles 6 jetting different ink colors at the time of printing/recording. By this configuration, it is possible to suppress the color mixture of different in colors to thereby obtain good image quality.

At the same time, this structure has a function to restrain invasion of a bonding agent when the channel substrate 1 and the heater substrate 2 are bonded with each other. That is, as shown in FIG. 2, there is provided no nozzle in the space 8 so that it is possible to make an ink reservoir distance D large enough to ensure a wide bonding area to bond the two substrates with each other. Consequently, even if an excessive bonding agent used for the bonding overflows, the nozzles adjacent to the bonding area are the dummy nozzles 7 and the distance W1 from the bonding area to the printing/recording nozzles 6 is large, so that there is no fear that the bonding agent invades the printing/recording nozzles 6 to thereby give influence to printing/recording. In this case, even if the jetting state of ink in the dummy nozzles 7 may become unstable because of the invasion of the bonding agent, the dummy nozzles 7 mentioned above are not used for printing/recording but only for performing jetting at the time of maintenance or the like. Therefore, there is no problem.

On the other hand, in the heater substrate 2, heating elements are provided correspondingly to the printing/recording nozzles 6 and the dummy nozzles 7, electrodes, a protective film and so on are formed, and a thick film resin layer 3 is provided thereon. Concave portions for connecting the ink channels to the ink reservoirs 4, and concave portions on the heating elements are formed in the thick film resin layer 3. The channel substrate 1 and the heater substrate 2 are bonded, and cut in a predetermined position of the ink channels so as to obtain a head chip.

Although a three-color integrated ink jet print head is shown in FIGS. 1A, 1B and 2, the present invention is not limited to three colors, but a similar configuration can be designed on an ink jet print head in which two or more colors are integrated. In addition, although only one dummy nozzle 7 is provided on each side wall of the ink reservoir 4 in the above embodiment, two or more dummy nozzles may be provided on each side. Further, the space 8 may be made wider to provide more than two nozzles.

Although the shallow grooved areas 9 are provided in the ink reservoirs 4 in the above structure, the present invention is not limited to this structure, but it can be applied to any wall surface of any ink reservoir, for example, to the above-mentioned structure of the ink reservoir 4 shown in FIGS. 12A to 12C.

FIGS. 3A and 3B, FIGS. 4A and 4B, FIGS. 5A and 5B, and FIGS. 6A and 6B are explanatory diagrams for the manufacturing process of an ink jet print head of an embodiment of the present invention. Parts in those drawings similar to those in FIGS. 1A and 1B and FIG. 2 are referenced correspondingly, and the description about them will be omitted. The reference numeral 11 represents a silicon nitride mask; 12, a silicon oxide mask; 13, a nozzle pattern; 14, a first ink reservoir pattern; and 15, a second ink reservoir pattern.

Figure 3A:
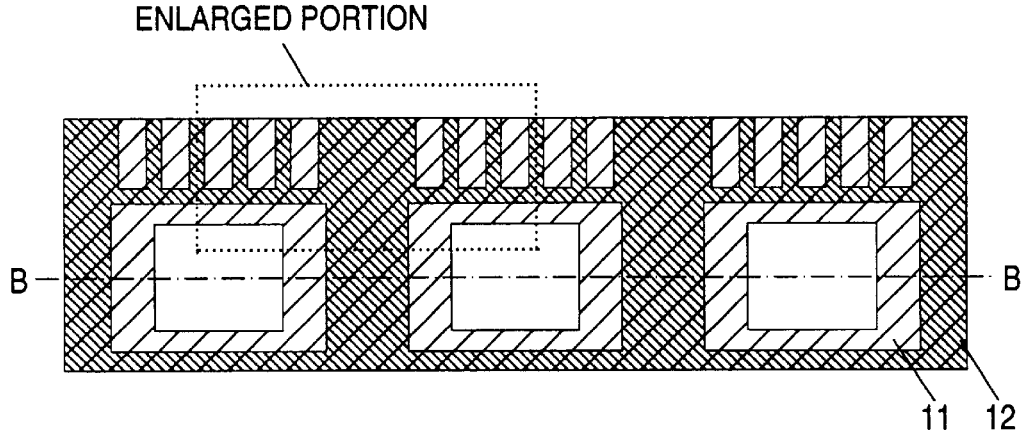
FIGS. 3A to 3C are explanatory diagram of a mask pattern formed on a channel substrate 1 for forming nozzles and ink reservoirs.
Figure 3B:
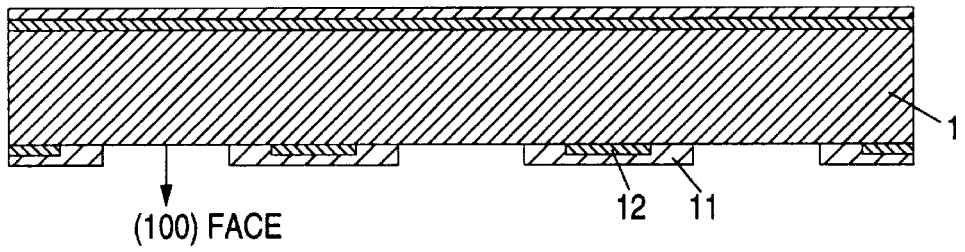
Figure 3C:
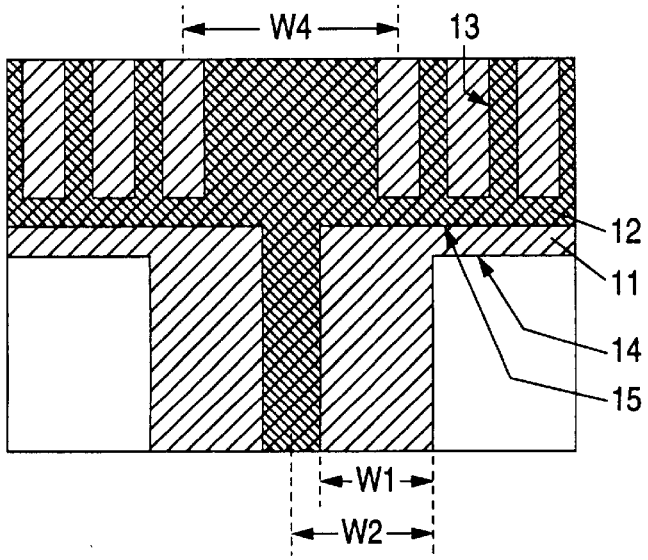

FIGS. 3A to 3C show a mask pattern formed on a channel substrate 1 for forming nozzles and ink reservoirs. Specifically, FIG. 3A is a front view of the substrate, FIG. 3B is a sectional view taken on line B—B, and FIG. 3C is an enlarged view of the portion surrounded by dotted lines in FIG. 3A.

First, after a silicon oxide ($SiO_2$) film (shown by right inclined hatching) is formed to be 700 nm thick on a first silicon substrate which has a (100) face and will be the channel substrate 1, patterning is performed in a photolitho process so that a nozzle pattern 13 corresponding to a nozzle portion and a second ink reservoir pattern 15 are eliminated. After that, etching is given thereto so as to form a silicon oxide mask 12. Next, a silicon nitride ($Si_3N_4$) film (shown by left inclined hatching) is formed to be 150 nm thick, and patterning is performed in a photolitho process so that a first ink reservoir pattern 14 is eliminated. After that, etching is given thereto so as to form a silicon nitride mask. Then, it is effective that a polysilicon film is coated on the silicon nitride film in order to prevent the back side of the substrate from being injured during the process. A silicon substrate 550 $\mu$m thick was used in this embodiment.

As for the mask pattern, the substrate is partitioned by the reservoir partition 5 so that ink of various colors is supplied from ink reservoirs to nozzles independently of each other. In addition, the first ink reservoir pattern 14 in the silicon nitride mask 11 is smaller than the second ink reservoir pattern 15 in the silicon oxide mask 12, as shown in FIG. 3C. As for the width of the mask pattern in the nozzle arrangement direction from the center between adjacent ink reservoirs, when W1 and W2 shown in FIG. 2 are used, the width of the first ink reservoir pattern is W2-W1 while the width of the second ink reservoir pattern is W2, and the relationship

W2> 22 W2– W1 is established. From the point of view of the width of an opening portion of the mask pattern, this means that the width of the opening portion of the first ink reservoir pattern is formed smaller than that of the second ink reservoir pattern. Nozzles communicating with the area of W2 are made dummy nozzles 7 which is not used for printing. In addition, distance W4 between the endmost nozzles of adjacent colors is integral times as large as the nozzle pitch used for printing, and herein a space wide enough to dispose therein further two nozzles, for example, the space 8 is formed so as to correspond to three nozzle pitches.

Figure 4A:
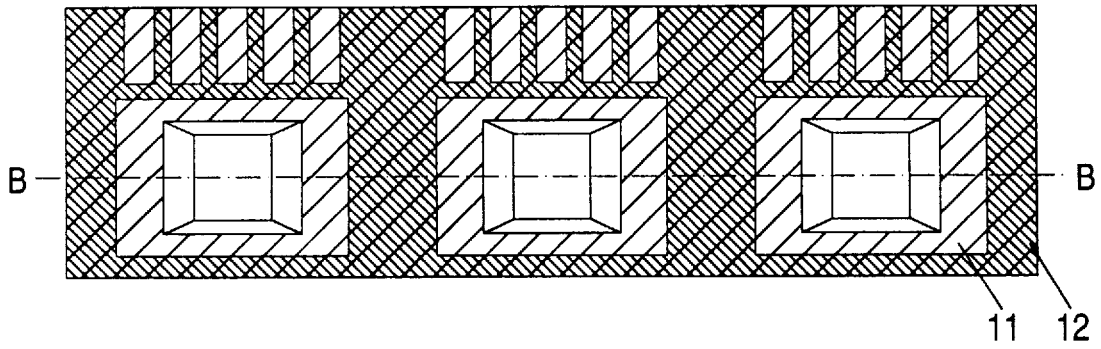
FIGS. 4A and 4B are explanatory diagram of a shape which has been subjected to first anisotropic etching.
Figure 4B:
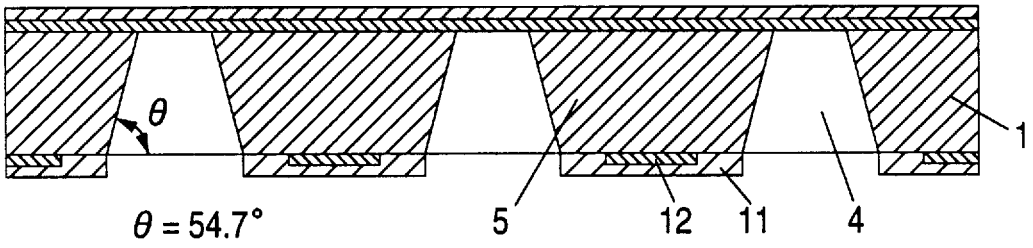

FIGS. 4A and 4B show the state after first anisotropic etching is given thereto. Specifically, FIG. 4A is a front view of the substrate, and FIG. 4B is a sectional view taken on line B—B. Through holes surrounded by (111) faces and having the angle of 54.7° with respect to the surface are formed by anisotropic etching. With potassium hydrate solution heated to 90° C. as the etching liquid, it takes about 4 hours to penetrate a silicon substrate 550 $\mu$m thick. Then not solved in the potassium hydrate solution, the silicon nitride mask 11 is under-cut by about 10 $\mu$m at the circumferential edge of the opening portion of the mask pattern, and the ink reservoir 4 is formed at an opening portion which is correspondingly larger than the opening portion of the mask pattern. Taking the amount of under-cut into consideration at the time of mask design, the amount can be corrected in advance.

Figure 5A:
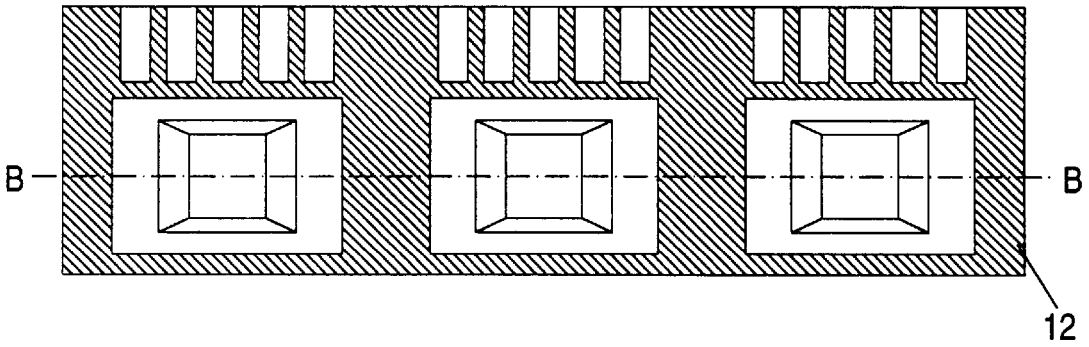
FIGS. 5A and 5B are explanatory diagram of a pattern after a silicon nitride mask 11 is eliminated.
Figure 5B:
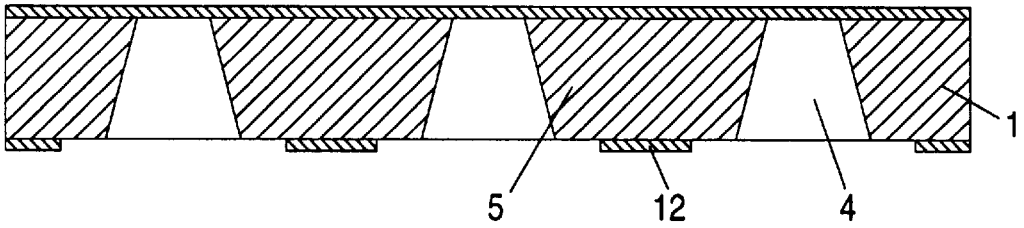

Next, the silicon nitride mask 11 is entirely eliminated by heated phosphoric acid. The pattern after the mask 11 is eliminated is shown in FIGS. 5A and 5B. FIG. 5A is a front view of the substrate, and FIG. 5B is a sectional view taken on line B—B. The drawings shows that the silicon oxide mask 12 has been left on the silicon substrate by eliminating the silicon nitride mask 11.

Figure 6A:
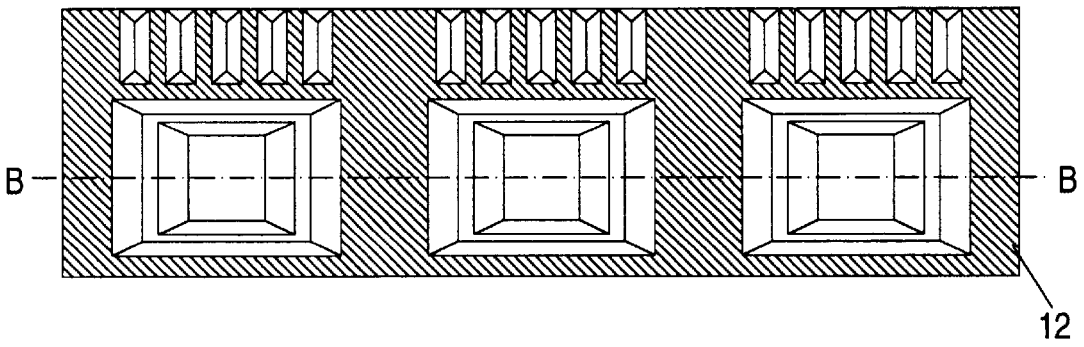
FIGS. 6A and 6B are explanatory diagram of a shape which has been subjected to second anisotropic etching.
Figure 6B:
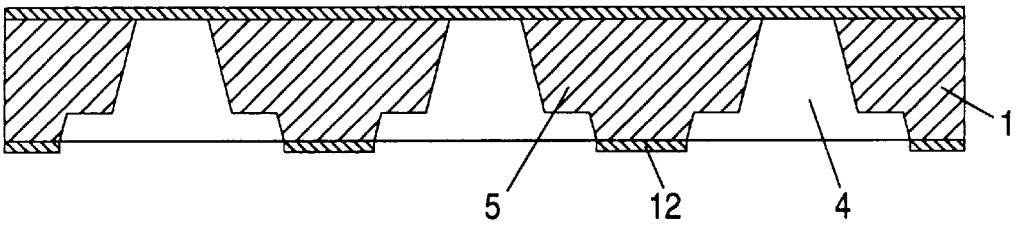

FIGS. 6A and 6B show the state after second anisotropic etching is given thereto. FIG. 6A is a front view of the substrate, and FIG. 6B is a sectional view taken on line B—B. Although potassium hydrate solution is used for etching in the same manner as in the first etching, etching time is set corresponding to the time to form nozzles. In addition, though solved in the heated potassium hydrate solution, the silicon oxide mask 12 is set to be thick enough to be proof against the etching time. In such a manner, ink channels and ink reservoirs 5 are formed. Each of the ink reservoirs 5 is etched by a large opening portion in the second anisotropic etching, and the etching time is short, so that the ink reservoir 5 is formed to have a step portion as shown in FIG. 6B. That is, the portion of the ink reservoir near the ink channels is shaped to be opened wider. Finally, the silicon oxide mask is entirely eliminated with fluorine acid, so that a first substrate which will be the channel substrate 1 is completed.

By forming the pattern of the ink channels and the ink reservoirs 4 in a photolitho process in such a manner, the distance between adjacent reservoirs or the distance between adjacent nozzles of different colors can be made very narrow and highly accurately. This is advantageous from the point of view of multi-nozzle and small chip. In practice, however, the endmost nozzles do not have performance similar to those of the other nozzles in view of their adhesion when substrates are bonded with each other, so that the endmost nozzles in each ink reservoir are made dummy nozzles 7 which are not used for printing in practice.

Figure 7:
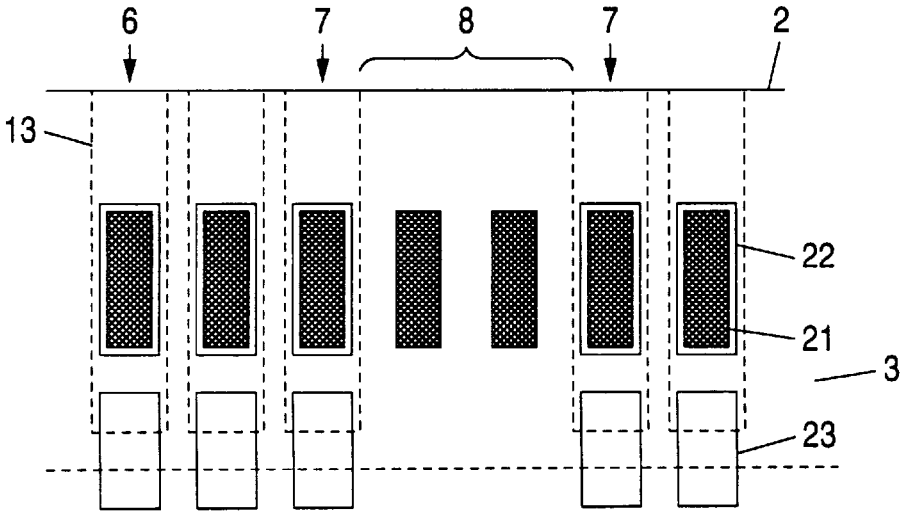
FIG. 7 is a plan view near nozzles in an ink jet print head of an embodiment of the present invention.

FIG. 7 is a plan view in the vicinity of nozzles in an ink jet print head of an embodiment of the present invention. In the drawing, parts similar to those in FIGS. 1A and 1B, FIG. 2, FIGS. 3A to 3C, FIGS. 4A and 4B, FIGS. 5A and 5B and FIGS. 6A and 6B are referenced correspondingly, and the description about them will be omitted. The reference numeral 21 represents a heating element; 22, a concave portion; and 23, a connection channel. A heater substrate 2 is formed separately from the above-mentioned channel substrate 1. In the same manner as the case of the channel substrate 1, heating elements 21 and electrodes electrically connected thereto are formed on a second silicon substrate corresponding to the nozzle pattern 13 formed on the channel substrate 1, and a protective film is formed on the heating elements 21. Further, a thick film resin layer 3 is formed. Concave portions 22 on the heating elements 21 are formed in the thick film resin layer 3, and connection channels 23 for connecting ink channels to ink reservoirs 4 are formed. These connection channels may be designed to be provided in the respective ink channels independently of each other as shown in FIG. 7, or to be made a common channel for every color.

In the embodiment shown in FIG. 7, heating elements 21 are also formed in a space 8 between adjacent dummy nozzles 7 of different colors, and these heating elements 21 are covered with the thick film resin layer 3. No ink channel is formed in this portion in the channel substrate 1. Therefore, there is no fear that adjacent and different-color ink intrudes through a channel to cause color mixture. Alternatively, ink channels having no opening portion formed in a portion of the space 8 may be provided in the channel substrate 1. Also in this case, the space 8 has no nozzle opening portion in the end surface of the head, so that a similar effect can be obtained.

In this embodiment, signal lines to be connected to the heating elements 21 which are in a portion of the space 8 are cut off or are not provided. Therefore, there is no fear that signals are fed to the heating elements 21 in the portion of the space 8 on error so as to make the heating elements to generate heat to heat the thick film resin layer 3. Of course, it is possible to design so that no heating element 21 is disposed in the portion of the space 8.

In addition, the dummy nozzles 7 have the same structure as the printing/recording nozzles 6 as shown in FIG. 7, so that jetting can be performed periodically at a home position or the like at the time of maintenance. Even if adjacent and different-color ink invades to the position, it is therefore possible to jet and eliminate the different color ink.

After the heater substrate 2 shown in FIG. 7 is manufactured, the heater substrate 2 is bonded with the channel substrate 1 manufactured as shown in FIGS. 3A to 3C and FIGS. 6A and 6B. At this time, the space 8 wide enough to dispose therein at least two nozzles is provided between the dummy nozzles 7 connected to adjacent and different-color ink reservoirs. Consequently, not only is it possible to ensure a bonding area with the second substrate, but also it is possible to counter the invasion of a bonding agent. At the same time, it is possible to avoid color mixture by the function of this space 8. The two substrates are bonded, and then divided into chips by means of a dicing saw or the like so as to make up the ink jet print head as shown in FIGS. 1A and 1B.

The two substrates are divided into the respective chips, and their surfaces where nozzles are to be opened are coated with a finishing agent in order to keep the directivity of jetting of ink drops. The coating is performed while compressed air is jetted from the nozzles in order to prevent the finishing agent from intruding the inside of the nozzles. The finishing agent is not coated all over the surface uniformly, but particularly coated only around the nozzle opening portions. Although the finishing agent is applied uniformly around the nozzle opening portions in the portion where the nozzles are arranged at a constant distance, the quantity of the applied finishing agent is changed in the end portions of the nozzles or when the distance between the nozzles is changed. Therefore, the coating of the finishing agent becomes ununiform in the portion of the dummy nozzles 7 on the both sides of the space 8, so that these dummy nozzles 7 are not used for printing/recording. On the contrary, because of providing the dummy nozzles 7, the finishing agent can be applied uniformly over the nozzles other than the dummy nozzles 7. Further, when the diameter and distance or pitch of the dummy nozzles 7 are made equal to those of the printing/recording nozzles 6, the finishing agent can be applied onto the portion of the printing/recording nozzles 6 uniformly. It is therefore possible to improve the directivity of ink drops jetted from the printing/recording nozzles 6, and improve the quality of a printed image.

Figure 8:
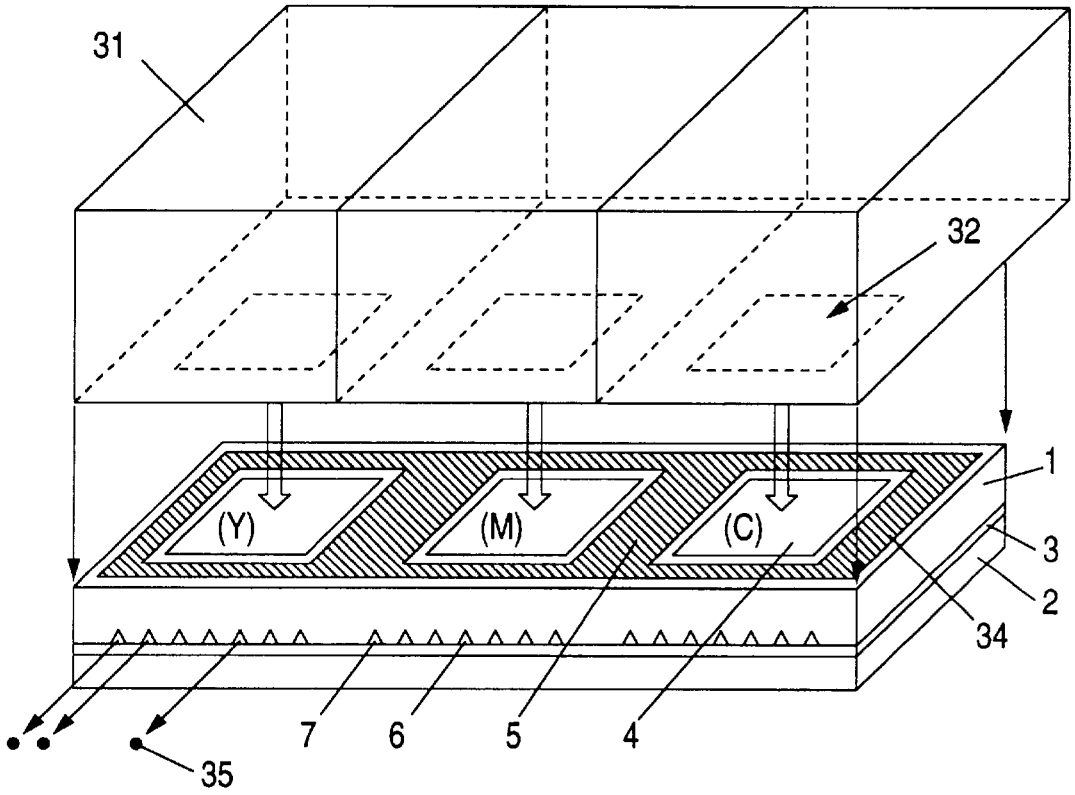
FIG. 8 is a schematic diagram illustrating an example of an assembly of an ink jet print head of an embodiment of the present invention.
Figure 9:
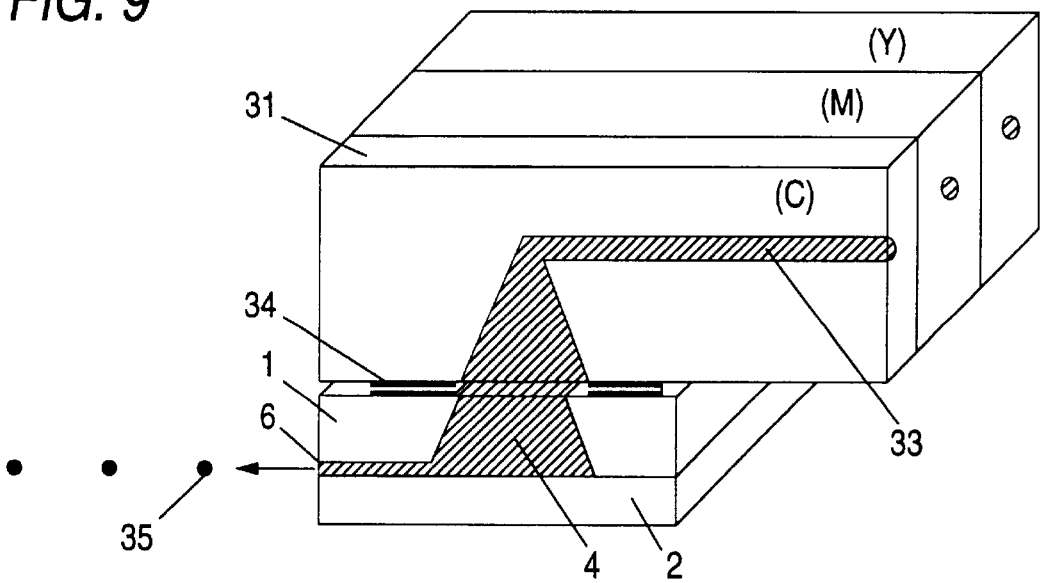
FIG. 9 is a schematic diagram which is partially sectional, illustrating an example of an assembly of an ink jet print head of an embodiment of the present invention.

FIG. 8 is a schematic view illustrating an example of an assembly of an ink jet print head of an embodiment of the present invention, and FIG. 9 is a schematic diagram which is partially sectional. In the drawings, parts similar to those in FIGS. 1A and 1B are referenced correspondingly, and their description will be omitted. The reference numeral 31 represents an ink supply members; 32, an ink supply hole; 33, an ink supply channel; 34, a sealing area; and 35, an ink drop. The ink jet print head manufactured in the above-mentioned manner is bonded with respective ink supply members 31, and supplied with ink of various colors from not-shown ink tanks.

The ink supply hole 32 corresponding to its associated ink reservoir 4 is provided in each of the ink supply member 31. Each ink reservoir 4 penetrates the channel substrate 1 as mentioned above, and the ink supply member 31 is attached to the substrate 1 so that this through hole is almost corresponding to its associated ink supply hole 32. The ink supply channel 33 is formed in each of the ink supply member 31, and ink passing this ink supply channel 33 is supplied, from the ink supply hole 32 and through the ink reservoir 4 of its associated color and respective ink channels, to the printing/recording nozzles 6 and the dummy nozzles 7. The ink is jetted as ink drops 35 from the printing/recording nozzles 6 at the time of printing/recording.

When the channel substrate 1 is bonded with the ink supply channel 33, the bonded portion is sealed with the sealing area 34. If the sealing area 34 is not ensured satisfactorily, sealing is not enough, so that there arises a problem that ink of different colors is mixed, or ink leaks out. If a large amount of sealing material is used, unpreferably the sealing material is pushed or overflowed into the ink reservoirs 4. It is therefore preferable to make the sealing area 34 as wide as possible. In the above-mentioned embodiment, the ink reservoirs 4 are formed by twice anisotropic etching, so that the through holes of the ink reservoirs 4 can be made small, and the sealing area 34 can be ensured satisfactorily.

After assembled in such a manner, the ink supply member 31 is installed, for example, in a carriage of an image recording apparatus or the like. When the carriage is driven by the image recording apparatus, the ink jet print head is moved and driven for printing during the movement to jet ink drops so as to record an image.

Figure 10:
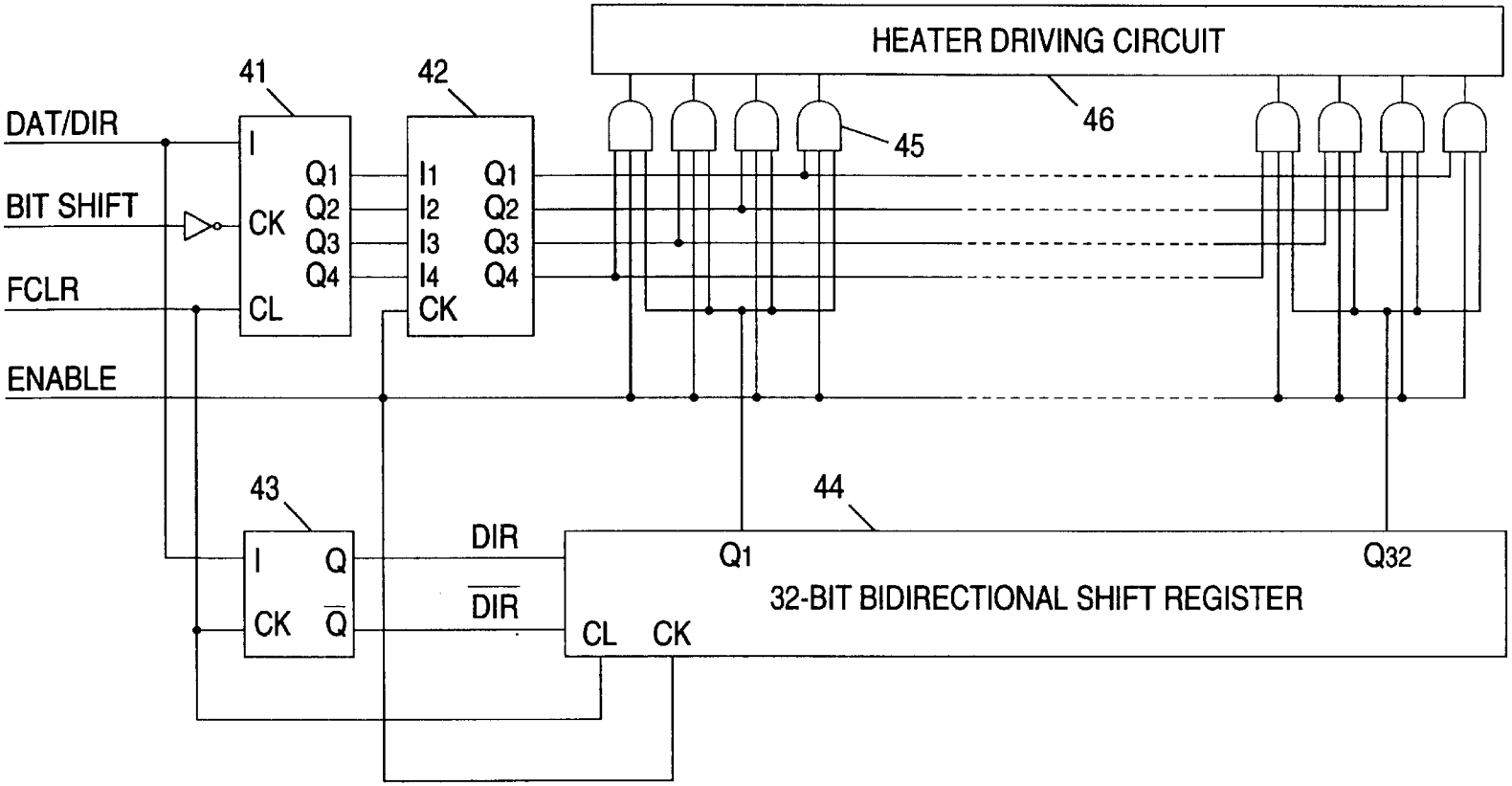
FIG. 10 is a block diagram of an example of a driving control portion in an embodiment of the present invention.
Figure 11:
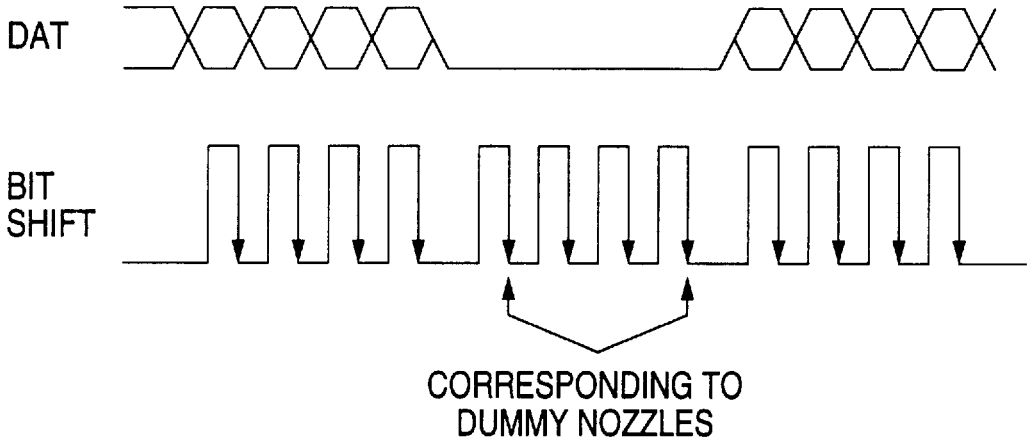
FIG. 11 is a partially explanatory diagram of an example of timing chart in an example of a driving control portion in an embodiment of the present invention.

FIG. 10 is a block diagram of an example of a driving control portion in an embodiment of the present invention, and FIG. 11 is a partially explanatory diagram of an example of timing chart in the same embodiment. In the drawings, the reference numeral 41 represents a 4-bit shift register; 42 and 43, latch circuits; 44, a 32-bit bidirectional shift register; 45, an AND circuit; and 46, a heater driving circuit. A DAT/DIR signal is a signal indicating printing data or scanning direction. A BIT SHIFT signal is a shift signal for the 4-bit shift register 41. An FCLR signal is a signal for performing reset of the 4-bit shift register 41 and the 32-bit bidirectional shift register 44 and latch in the latch circuit 43. An ENABLE signal is a timing signal for driving nozzles. Herein, a structure to drive 128 nozzles is shown.

The AND circuit 45 is provided, for example, so as to correspond to the heating elements 21 shown in FIG. 7 so that the AND circuit 45 controls by its output the heater driving circuit 46. In this embodiment, four nozzles are regarded as one block, and respective blocks are driven sequentially. Therefore, each of output terminals $Q_1, \ldots, Q_{32}$ of the 32-bit bidirectional shift register 44 are connected to four AND circuits 45.

With the FCLR signal, the 4-bit shift register 41 and the 32-bit bidirectional shift register 44 are reset, and the latch circuit 43 latches the DIR signal at the leading edge of the FCLR signal, so that the shift direction of the 32-bit bidirectional shift register 44 is determined. After that, image data are sent out as the DAT/DIR signal from the 4-bit shift register 41, and at the same time the BIT SHIFT signal is supplied to the 4-bit shift register 41 as a clock thereof. As shown in FIG. 11, the image data are taken into the 4-bit shift register 41 sequentially at the trailing edge of the BIT SHIFT signal. When the 4 bits image data are taken in, they are latched in the latch circuit 42 at the leading edge of the ENABLE signal. The latched image data are given to the AND circuits 45. On the other hand, the 32-bit bidirectional shift register 44 is shifted with the ENABLE signal as clock, and the output from one of the output terminals $Q_1, \ldots, Q_{32}$ thereof is supplied to the AND circuits 45. Therefore, only four AND circuits 45 in one block selected by the 32-bit bidirectional shift register 44 are driven in accordance with the image data. At this time, the heater driving circuit 46 is driven to heat the heating elements for a period in which the ENABLE signal is "H", so that ink drops are jetted for printing/recording. In such a manner, the output terminals of the 32-bit bidirectional shift register 44 are shifted sequentially whenever the ENABLE signal is supplied thereto, and the 32 blocks of heating elements are driven sequentially four by four.

When such a driving control portion for driving 128 nozzles is applied to an ink jet print head as shown in FIGS. 1A and B, FIG. 2, FIGS. 3A to 3C, FIGS. 4A and 4B, FIGS. 5A and 5B, FIGS. 6A and 6B, FIG. 7, and FIGS. 8 and 9, for example, 40 nozzles are used for every color in the case of a three-color integrated head. The number of blocks driven for every color is 10. Therefore, the number of the printing/recording nozzles 6 is 120. The rest 8 nozzles are not used for printing/recording. That is, four nozzles constituted by two dummy nozzles 7 provided between respective colors and two nozzles which can be disposed in the space 8 between the dummy nozzles 7 are driven as one block. Since such dummy nozzles 7 and space 8 between respective colors are provided in two places in the case of the three-color integrated head, the sum of the nozzles is 8 corresponding to two blocks.

When blocks 1 to 32 are driven sequentially for printing/recording, first, the blocks 1 to 10 are driven so as to perform printing/driving with one color. The next block 11 is a block which is not used for printing. Therefore, as shown in FIGS.

1A and 1B, a signal (herein "L" signal) indicating no printing is supplied to the DAT/DIR signal as image data, or an AND circuit for prohibiting the output from the output terminal $Q_{11}$ of the 32-bit bidirectional shift register 44 is added so that it is possible to prevent the dummy nozzle 7 from being driven. The next blocks 12 to 21 are driven sequentially for printing with ink different in color from the, ink for the blocks 1 to 10. Since the next block 22 corresponds to the dummy nozzle 7, the block 22 is not driven for printing. The next blocks 23 to 32 are driven sequentially for printing with ink of the third color.

On the other hand, when the dummy nozzles 7 are also driven for maintenance or the like, for example, "H" is supplied as image data for the dummy nozzles 7, and the output of the output terminals $Q_{11}$ and $Q_{22}$ of the 32-bit bidirectional shift register 44 is permitted.

As has been described above, according to the printing driving portion shown in FIG. 10, nozzles for jetting ink of different colors can be driven and controlled in common. In addition, the sum of the number of the dummy nozzles 7 and the number of nozzles which can be disposed in the space 8 are set as one block in a portion where nozzles for jetting different-color ink are disposed adjacently to each other, so that the jetting of the dummy nozzles 7 can be controlled easily. Particularly in the structure where four nozzles are controlled as one block, it is possible to control the dummy nozzles 7 easily when the number of the dummy nozzles 7 is two, and also the number of the nozzles which can be disposed in the space 8 is two.

Since the nozzles on the both ends of the head are disposed in the end portions of the ink reservoirs 4, they are not disposed between different colors, but they can be controlled as dummy nozzles which are not to be used. Alternatively, dummy nozzles which do not jet ink may be formed in the outside. It is not always necessary for the nozzles to have the same structure as that of the above-mentioned dummy nozzles between different colors. The present invention is not limited to printing/driving control as mentioned above, but it can be applied to various controls of print driving.

As is apparent from the above description, according to the present invention, two or more dummy nozzles which can jet ink though not used for printing/recording are provided in a portion where different ink colors are adjacent to each other, and a space wide enough to dispose therein two or more nozzles is provided between at least two dummy nozzles, so that there is an effect that it is possible to provide an ink jet print head and an image recording apparatus in which not only color mixture but also failures in ink jetting can be prevented so that stable printing can be performed.

What is claimed is:

1. An ink jet print head comprising:

nozzles for jetting ink of a plurality of different colors for performing printing/recording, and at least two dummy nozzles which are not used for performing printing/recording, are provided between said nozzles, wherein a space which is wide enough to dispose therein two or more nozzles is provided between the at least two dummy nozzles, the space being free from nozzles and dummy nozzles.

2. The ink jet print head of claim 1, wherein said dummy nozzles are designed so as to be able to jet ink in response to a printing signal.

3. The ink jet print head of claim 1, wherein said dummy nozzles have substantially the same jetting hole as said nozzles for performing printing/recording.

4. The ink jet print head of claim 1, wherein said dummy nozzles are disposed at the same intervals among the nozzles as said nozzles for performing printing/recording.

5. An ink jet print head comprising:

nozzles for jetting ink of a plurality of different colors, and at least four dummy nozzles not being used for performing printing/recording which are provided between said nozzles, wherein said dummy nozzles directly adjacent to said nozzles are inside dummy nozzles with opening portion so as to be able to perform printing, and said dummy nozzles directly adjacent to said inside dummy nozzle are outside dummy nozzles with opening portion being closed.

6. The ink jet print head of claim 5, further comprising:

wires for supplying a printing signal which are provided for said outside dummy nozzles.

7. An image recording apparatus having nozzles for jetting ink of a plurality of different colors comprising:

a first nozzle group for jetting ink, a second nozzle group adjacent to said first nozzle group and for jetting ink different in color from the ink jetted from said first nozzle group, first dummy nozzles with no opening portion disposed between said first nozzle group and said second nozzle group, and second dummy nozzles with an opening portion so as to perform printing disposed between said first dummy nozzle and said first nozzle group, and between said first dummy nozzle and said second nozzle group, respectively.

8. The ink jet print head of claim 7, wherein said second dummy nozzles have substantially the same jetting hole as said nozzles for performing printing/recording.

9. The ink jet print head of claim 7, wherein said first and second dummy nozzles are disposed at the same intervals as said nozzles for performing printing/recording.

* * * * *